United States Patent [19]

Parker

[11] Patent Number: 4,956,577

[45] Date of Patent: Sep. 11, 1990

[54] INTERACTIVE LUMINOUS PANEL DISPLAY DEVICE

[76] Inventor: William P. Parker, Box 909, Waitsfield, Vt. 05673-0909

[21] Appl. No.: 235,660

[22] Filed: Aug. 24, 1988

Related U.S. Application Data

[63] Continuation-in-part of Ser. No. 192,225, May 10, 1988, Pat. No. 4,887,003.

[51] Int. Cl.[5] ..... H01J 17/02; H01J 17/16; G09G 3/02

[52] U.S. Cl. ..... 313/634; 313/484; 313/493; 313/587; 340/712

[58] Field of Search ..... 313/484, 493, 494, 634, 313/582, 212, 583, 587; 361/212; 340/712; 341/33

[56] References Cited

U.S. PATENT DOCUMENTS

| | | | |
|---|---|---|---|
| 2,004,577 | 6/1935 | Lebedenko et al. . | |
| 3,127,535 | 3/1964 | Westerheim | 313/109.5 |
| 3,500,390 | 3/1970 | McNaney | 340/378 |
| 3,559,190 | 1/1971 | Bitzer et al. | 313/583 X |
| 3,621,332 | 11/1971 | Janning | 315/313 |
| 3,629,638 | 12/1971 | Veron et al. | 313/109.5 |
| 3,629,654 | 12/1971 | Janning | 315/246 |
| 3,646,384 | 2/1972 | Lay | 313/109.5 |
| 3,764,429 | 10/1973 | Janning | 156/89 |
| 3,903,445 | 9/1975 | Bode et al. | 313/226 |
| 3,971,013 | 7/1976 | Challoner et al. | 313/583 X |
| 3,987,337 | 10/1976 | Nishida et al. | 315/168 |
| 3,998,510 | 12/1976 | Salisbury | 316/17 |
| 4,019,086 | 4/1977 | Person et al. | 313/518 |
| 4,035,690 | 7/1977 | Roeber | 315/169 |
| 4,106,009 | 8/1978 | Dick | 340/343 |
| 4,157,543 | 6/1979 | Person | 340/758 |
| 4,185,229 | 1/1980 | Yoshikawa et al. | 315/169.4 |
| 4,320,324 | 3/1982 | Ariga et al. | 313/493 |
| 4,414,490 | 11/1983 | Harvey | 315/169.4 |
| 4,427,479 | 1/1984 | Glaser | 156/286 |
| 4,451,761 | 5/1984 | Kay | 313/586 |
| 4,494,038 | 1/1985 | Wedding et al. | 313/587 |
| 4,529,909 | 7/1985 | Kamegaya et al. | 313/584 |
| 4,549,109 | 10/1985 | Nighan et al. | 313/485 |
| 4,554,482 | 11/1985 | Kamegaya et al. | 313/582 |
| 4,554,537 | 11/1985 | Dick | 340/775 |
| 4,566,006 | 1/1986 | Okamoto et al. | 340/771 |
| 4,584,501 | 4/1986 | Cocks et al. | 313/493 |
| 4,611,203 | 9/1986 | Criscimagna et al. | 340/773 |
| 4,613,794 | 9/1986 | Oida | 315/169.4 |
| 4,803,402 | 2/1989 | Raker et al. | 313/587 X |

FOREIGN PATENT DOCUMENTS

| | | | |
|---|---|---|---|
| 86061 | 6/1980 | Japan | 313/634 |

OTHER PUBLICATIONS

Title unknown, Electronic Display Matrix and Alphanumeric Devices, pp. 212–221, date unknown.

*Primary Examiner*—Sandra L. O'Shea
*Attorney, Agent, or Firm*—Lahive & Cockfield

[57] ABSTRACT

A gas discharge display apparatus in the form of a panel housing a plurality of electroluminescent gas-filled discharge chambers adapted for interactively controlled illumination. The apparatus generally includes an electrically conductive surface underlying the discharge chambers utilized as an electrode for energizing the electroluminescent gas in the chambers. A plasma glow discharge is interactively obtained in the chambers by placing a ground coupled conductive member, such as a human hand, proximal to the chambers opposite the conductive surface.

45 Claims, 1 Drawing Sheet

INTERACTIVE LUMINOUS PANEL DISPLAY DEVICE

REFERENCE TO RELATED APPLICATION

This application is a continuation-in-part of my U.S. patent application Ser. No. 192,225, entitled Screen Printable Luminous Panel Display Device, filed May 10, 1988 now U.S. Pat. No. 4,887,003 issued 12/12/89. That application is incorporated herein by reference.

BACKGROUND OF THE DISCLOSURE

The invention is in the field of luminous displays and signs, and more particularly relates to gas plasma display devices.

The production of light by the passage of electricity through gases is a well known phenomenon. Devices utilizing this phenomenon have been widely developed in the form of plasma display devices which display specific numerals, characters, symbols, graphics, and the like. The neon sign is an example of a gas discharge display device, typically including an elongated glass tube filled with neon and a pair of excitation electrodes disposed at opposite ends of the tube. In this example, the rigid tube, or envelope, defines the shape of the illumination pattern. This shape is established at the time of manufacture, and cannot be changed.

Other prior art gas discharge display devices may include a base electrode and a plurality of shaped character electrodes in direct or close contact with an electroluminescent gas within a glass envelope, for example, Nixie tubes. In such devices, selected ones of the shaped electrodes may be energized with respect to the base electrode to obtain a desired character display. Again, the shape of the illumination is predetermined by the shape of the electrode which is established at the time of manufacture of the device.

Still other forms of prior art gas discharge display devices include dielectric-bounded, gas-filled character-shaped channels within an envelope, with a suitable set of energizing electrodes. As in U.S. Pat. No. 3,621,332, a plurality of such channels may be established within a single envelope, with electrodes being arranged for selective activation of one channel at a time. Alternatively, as in U.S. Pat. No. 4,584,501, a single elongated channel may be formed in one plate of a two glass plate sandwich arrangement, with energizing channels in an adjacent plate. All of these arrangements are suitable for displaying indicia, but as with the earlier discussed prior art, the shape of the display, i.e. the channel configuration, is determined at the time of manufacture of the device.

Yet other prior art gas discharge devices include generally similar display configurations, but have an addressable matrix in which selected dot regions may be selectively energized. For example,
shown in U.S. Pat. No. 4,035,690, selected ones of overlapping orthongal sets of electrodes may be energized to generate a desired dot matrix character. In that patent, the electroluminescent gas is confined to the interior of a plurality of dielectric spheres disposed between the sets of electrodes. With the dot addressable matrix, substantial flexibility is provided in that any dot pattern graphics may be displayed, for example using conventional bit-mapped graphics techniques. However, as with the other above mentioned prior art, all possible display patterns, i.e. the electrode overlap regions, are established at the time of manufacture of the device.

Yet another form of prior art gas discharge device is disclosed in U.S. Pat. No. 3,629,654. As shown in that patent, a pair of opposed, spaced apart plates are mutually sealed at their perimeter to establish an electroluminescent gas filled cell. A transparent conductive coating is disposed on one outer surface of the cell. A movable external sheet having predetermined shaped conductive regions is pressed against the other outer surface of the cell and an ionizing signal is applied across the conductive coating and the conductive region of the external sheet to generate a visible discharge in the cell having the shape of the conductive regions of the external sheet. This two-element display thus requires a means for positioning the external sheet relative to the cell in order to establish an image.

In the prior art there are many known techniques and circuits for the interactive control of luminous and lighting devices. Many of these are commercially available as "touch control" light dimmers or switches. These generally employ circuitry that senses an external field or capacitance, as that of a human body or any of its parts, either by close proximity or by direct contact with a circuit element.

In these devices, the effect of the application of the external field or capacitance is an alteration of the circuitry's operating state, leading to an offset voltage or current internal to the circuit. This voltage or current offset is then applied to some interconnected lighting device, i.e., an incandescent lightbulb, thus changing its brightness in a response to either the duration or character of the externally applied influence.

The term "interactive" here applies to the nature of the control mechanism, it being the control loop formed by the person initiating or continuing the influence on the circuit and the circuit's response in changing the light output of the lighting device, with feedback between the light output of the lighting device and the Person. The interaction of the person with the (control mechanism/lighting device) combination results in a change in the operating parameters of the combination, i.e., a modification of the light output of the lighting device. Lighting control devices of this type may be characterized as indirect interacting, due to the indirect nature of the control influence on the lighting device itself.

It is also known in the prior art to directly interact with the method of light production, and thus directly control the lighting device. By way of example, there are certain gas plasma artistic works, such as those of the present inventor, in which an electroluminescent gaseous medium is contained in an enclosed gas tight chamber and disposed about an electrode centrally located within the chamber. When the electrode is suitably energized, a luminous plasma discharge is established from the electrode, through the chamber to a reference potential outside the chamber. With such devices, when a person touches the chamber surface, the person's body, or some part of thereof, acts as a capacitor plate and thereby allowing the passage of alternating current between the electrode and the reference potential along field lines that are directly related to the body capacitance and its point of application to the chamber wall. This capacitor effect acts as charging means for the luminescent gas, producing what is termed a capacitive discharge. When in use, the device responds to the proximity of the body, or any other such effective capacitor plate, in direct correspondence to it capacitance, and a luminous display is produced that is directly related to its distance from the central electrode.

It is an object of the present invention to provide an improved plasma display device.

Another object is to provide an improved plasma display device which may be interactively controlled, for example by a person's body capacitance, to establish a luminous plasma display.

SUMMARY OF THE INVENTION

Briefly, the present invention includes one or more electroluminescent gas-filled enclosures. An electrode surface is disposed on one side of the gas space, and provision is made for coupling an externally applied effective capacitive plate on the other side of the gas space. With that configuration, a luminous gas (or plasma) discharge is generated in localized regions in the gas space near the external capacitive plate when the electrode is suitably energized and an external effective capacitive plate establishes a ground-coupled capacitance between that plate and the electrode, when the gas space is between those elements. Generally, the resultant pattern of light from the discharge has the shape of the effective plate of the capacitance.

The display device of the present invention may be constructed with the gas enclosures sandwiched between a pair of rigid members, providing a robust and durable device. Where those members have a planar sheet form, with at least one being transparent, the device is well suited for use as a dynamic interactive table or counter top or as a wall or floor panel, with luminous patterns being generated in response to touching by a human user (which provides the effective external capacitive plates).

In application, the device is useful in a variety of situations where proximity light control is desired, for example in direct interacting lighted walkways. These would consist of a sequence of gas filled panels each with a conductive plate underneath and a transparent nonconducting cover plate. The proximity and body capacitance of the person walking on the panel initiates a local gaseous discharge, which in turn generates light in the panel. A simple design consists of a sandwich construction of a metal plate at the bottom, a layer of uniformly spaced illuminable gas-filled tubes directly above this plate, and a top cover of tempered glass. The pressure of a person's body on the top cover is transmitted to the bottom plate, and then to any other vertical support means, by way of nonconducting vertical elements placed between the tubes with a height greater than the diameter of the tubes.

The display panel is also generally useful in the architectural and outdoor illumination field. Similarly, much as artists and designers use light filled tubes as components of graphic and sculptural statements, the light producing display devices of the invention may be used as an interactive artistic and design medium.

More particularly, in accordance with the invention, a display device includes an at least partially transparent first non-conductive sheet member having front and back surfaces. A base member, having front and back surfaces, and preferably a sheet material, includes an electrically conductive region. The base member may itself be electrically conductive, or a conductive film may be positioned on either the front or back surface of, or sandwiched between those surfaces of, the base member. In a preferred form, the sheet and base members are substantially planar, but alternative configurations could be employed, such as similar cylindrical or spherical configurations. By way of example, the sheet and base members may be parallel, planar sheets of glass, or polycarbonate, or acrylic or other material.

The sheet member may be substantially transparent and has a coupling region on its front surface adapted to receive an externally applied, ground-coupled conductive member (such as a human hand) on portions thereof. Typically, this externally applied conductive member establishes the image to be displayed.

One or more spacer elements mutually position the sheet and base members so that the back surface of the sheet member is offset by a predetermined distance D from and opposite the front surface of the base member, and so that the conductive region of the base member underlies at least in part the coupling region of the sheet member.

A discharge chamber establishes one or more gas impervious chambers between portions of the back surface of the sheet member and the front surface of the base member. The discharge chambers define closed regions in the gap between the back surface of the sheet member and the front surface of the base member. Those closed regions lie at least in part between the coupling region of the sheet member and conductive region of the base member.

An electroluminescent gas is disposed within the closed regions. While other gas mixtures may be used, in the preferred form the electroluminescent gas is a Penning gas mixture comprised substantially of neon at a pressure in the approximate range 40–200 torr.

In a preferred form of the invention, the conductive region of the base member is formed by a conductive coating disposed on a portion of one of the front and back surfaces of the base member underlying at least in part the closed regions and a part of the coupling region of the sheet member. Alternatively, the base member may be a conductive material, such as an aluminum plate.

An applied drive voltage may be coupled between the conductive region of the base member and a reference (such as ground) potential to energize the device so that a luminous plasma image may be established in the portions of the closed region between the overlying portions of the conductive region and coupling region by the application of a ground-coupled external conductive member (such as a human hand) to the coupling region of the sheet member.

In one form of the invention, the spacer includes at least one rigid spacer member disposed within the closed region and extending between the back surface of the sheet member and the front surface of the base member.

In various embodiments, the base member and its conductive region may be substantially translucent or transparent, reflective or opaque. In embodiments where the base member is conductive, or where the conductive region of the base member is established by a conductive film on the back surface of that base member, a non-conductive material may overlie the conductive region opposite the back surface of the base member. The latter non-conductive material may be used to ensure that a user does not contact the electrode during use. Further, that added material provides increased resistance to breakage of the device as a whole.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
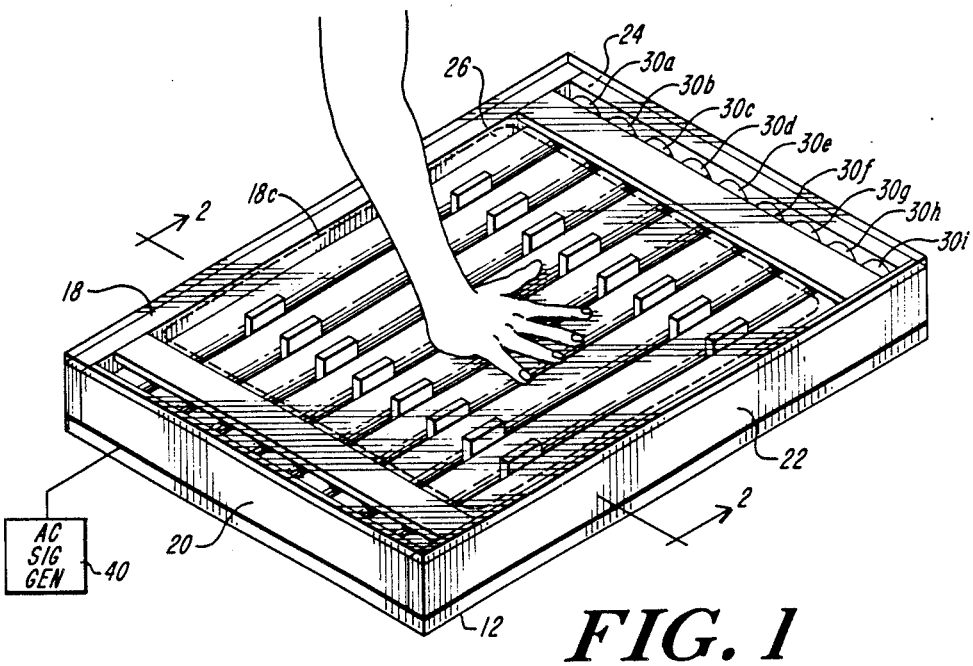
FIG. 1 shows in perspective view, a display device according to the present invention.

An exemplary luminous (plasma) display device 10 is shown in FIG. 1 in perspective form. The device 10 includes two flat and parallel non-conducting, transparent sheet members 12 and 18 having "front" surfaces 12*a* and 18*a*, respectively, and "rear" surfaces 12*a* and 18*b*, respectively. As shown, sheet members 12 and 18 are substantially planar, but other forms might also be used, such as cylindrical or conical.

In the preferred embodiment, sheet (or base) member 12 is a one foot by four feet, 3/16 inch thick polycarbonate (Lexan TM ) panel. Sheet member 12 bears a conductive coating 14 on its front surface 12*a*. In the preferred embodiment, coating 14 is provided by nickel oxide spray paint, such as E-Kote TM 63 Nickel Conductive Paint manufactured by Acme Chemicals and Insulation Co, New Haven, Conn.

Sheet member 18 is a one foot by one foot, $\frac{1}{4}$ inch thick thermally tempered glass panel positioned so that its bottom (or back) surface 18*b* is opposite and spaced apart by a predetermined distance D ($\frac{7}{8}$ inch in the preferred embodiment) from the coating 14 front surface 12*a* of sheet member 12. In the preferred form of the invention, this spatial relationship of sheet members 12 and 18 is established by non-electrically conductive peripheral support members 20, 22, 24 and 26. In the embodiment of FIG. 1, those support members 20, 22, 24 and 26 are constructed of high modulus wood such as oak. Other non-conductive materials may readily be used to form a fully enclosed region between surfaces 12*a* and 18*b*.

A set of nine 46 inch long, $\frac{1}{2}$ inch inner diameter, $\frac{3}{4}$ inch outer diameter, closed end, cylindrical Pyrex glass tubes 30*a*–30*i* are positioned in parallel within the space between surfaces 12*a* and 18*b*. Each of the tubes 30*a*–30*i* provides an enclosed interior region which is filled with an illuminable, or electroluminescent, gas. In the illustrated form of the invention, the gas is neon at a pressure of 88 torr. Pressures in the range of 40–200 torr might also be used, although other gas mixtures and pressures may be used for these and other sized tubes.

The tubes 30*a*–30*i* are maintained at a substantially uniform spatial separation by rigid, non-electrically conductive spacers 36*a*–36*h* at each end of the region between surfaces 12*a* and 18*b* and at uniformly spaced locations along the length of tubes 30*a*–30*i*. The spacers 36*a*–36*h* have a dimension equal to $\frac{7}{8}$ inches in the direction perpendicular to surfaces 12*a* and 18*b* and provide support to keep the sheet members 12 and 18 in position, even as external forces are applied to those sheet members.

The resultant configuration for display panel 10 is a rugged device suitable to support the weight of a person or for use as a table or bar-top. The device might also be constructed without the spacers, depending on forces expected to be encountered.

Figure 2:
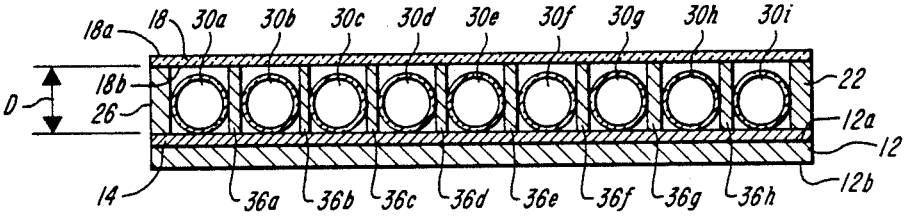
FIG. 2 shows, in section, the portion of the display device of FIG. 1.
Figure 3:
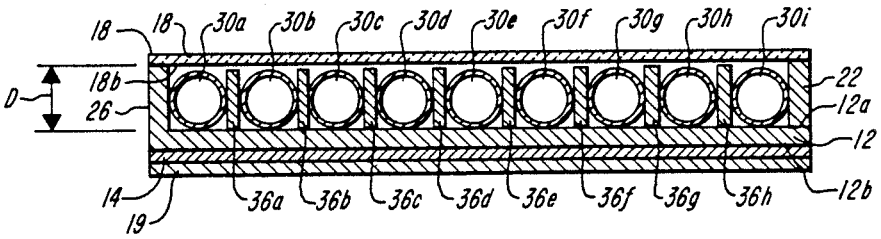
FIG. 3 shows, in section, a portion of an alternative embodiment of the display device of FIG. 1.

FIG. 3 shows an alternative embodiment, generally similar to that of FIGS. 1 and 2 but where spacers 36*a*–36*h* are less than D but greater than the diameter of the tubes 30*a*–30*i*. In that embodiment, the conductive coating 14 is on the back surface 12*b* of sheet member 12, and a non-conductive sheet 19 is on the outer surface of coating 14.

In operation, an AC signal generator 40 provides a 9 KV, 38 KHz excitation voltage to the conductive coating 14 relative to ground potential. Under these conditions a person may bring his hand, for example, to the region 18*c* of the front surface 18*a* of sheet member 18, as illustrated in FIG. 1. Where that hand is on or near the region 18*c* of surface 18*a*, a capacitive effect causes the AC electric field from the region of coating 14 underlying the hand to pass from that region of the coating to the hand and then to ground potential. That field, as it passes through the interior region of the portions of tubes 30*a*–30*i* underlying the hand, causes the gas in those and adjacent interior regions to produce a glow discharge. The extent of the image beyond the outline of the conductive member depends in part on the gas pressure and applied frequency and voltage, and distance of the conductive member from the surface 18*a*.

Thus, the use of conductive coating 14 on the glass sheets 12 allows the panel 10 to illuminate when attached to a source of driving voltage and a suitable ground-coupled conductive member is positioned proximal to surface 18*a*. There are several ways to configure the conductive coating 14, depending on the desired visual and operational properties of the final panel 10. The panel 10, as shown in FIG. 1 has a conductive coating 14 on the "inner" surface of the sheet 12 with the electroluminescent gas located between the sheets 12 and 18. Three basic types of conductive coatings identified by their optical properties may be used; namely, translucent or transparent, reflective, and opaque.

Transparent conductive coatings pass light, and have little or no color, thus making the coating invisible to the eye. Examples of this kind of coating are vacuum evaporated or sputtered metal films, usually gold or aluminum, and indium doped tin oxide films, either sputtered or chemically deposited on the glass sheet. The coating may be applied for use with a transparent, reflective or opaque base member.

Reflective conductive coatings reflect light, or reflects some percentage of the light falling on it, and are generally partially transparent and partially reflective. Examples are aluminum, chromium, silver or gold coatings with a reflectivity over 10%. The coatings may be applied by sputtering, evaporation, chemical deposition or mechanical means, i.e. embossing, and may be applied as patterns or may be uniform and continuous. The resistivity varies from 0.01 to 10 ohms/square for the coatings.

Opaque conductive coatings do not allow the penetration of light to any significant extent. Such coatings allow the view of the gas discharge from one direction only, and give it a higher contrast background. The coating is generally of a paint or ink type consisting of a vehicle, a binder and a conductive component in suspension such as nickel oxide, nickel metal powder, graphite, or mixes of these materials. It may be applied by spraying, rolling, brushing or any of a host of mechanical or chemical means.

The preferred embodiment represents one form of the invention. The parameters variables of gas containment method, gas mixture, gas pressure, capacitor charging voltage, drive voltage frequency and amplitude and general panel geometry may all be selectively varied to provide desired variations in the operation and visual characteristics of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An interactive luminous display device comprising:

a. an at least partially transparent, non-conductive sheet member having front and back surfaces, said first sheet member having a coupling region on portions of its front surface, said coupling region being adapted to receive thereon an externally applied conductive member;

b. a base member having front and back surfaces, and including an electrically conductive region on at least one of said surfaces;

c. spacer means for mutually positioning said sheet member and said base member whereby the back surface of said sheet member is offset by a predetermined distance from and opposite the front surface of said base member and said conductive region of said base member underlies at least a portion of said coupling region of said sheet member;

d. discharge chamber means for establishing one or more discrete gas impervious chambers between portions of the back surface of said sheet member and the front surface of said base member, said chambers defining closed regions in the gap between said back surface of said sheet member and the front surface of said base member and lying at least partially between said coupling region and said conductive region of said base member; and e. electroluminescent gas disposed within said closed regions.

2. A display device according to claim 1 further comprising means for coupling an applied a.c. drive voltage between said conductive region and a reference potential, and wherein said device is responsive to a ground potential-coupled conductive member positioned proximal to said coupling region to generate a luminous gas discharge in the portions of said closed regions between said conductive member and said conductive region of said base member.

3. A display device according to claim 1 wherein said front and back surfaces of said first sheet member are substantially parallel.

4. A display device according to claim 3 wherein said front and back surfaces of said base member are substantially parallel.

5. A display device according to claim 1 wherein said front surface of said first sheet member and said back surface of said base member are substantially planar and mutually parallel.

6. A display device according to claim 1 wherein said base member is substantially transparent.

7. A display device according to claim 1 wherein said sheet member and said base member are materials from the group consisting of glass and polycarbonate.

8. A display device according to claim 1 wherein said spacer means includes said discharge chamber means and further includes at least one rigid spacer member disposed within said closed region and extending from one of said back surface of said sheet member and said front surface of said base member and toward the other of said surfaces.

9. A display device according to claim 8 wherein said rigid spacer members extend less than the full distance between said back surface of said sheet member and said front surface of said base member when said electroluminescent gas is at a predetermined pressure in said closed region.

10. A display device according to claim 1 wherein said electroluminescent gas is a Penning gas mixture.

11. A display device according to claim 10 wherein said gas mixture is comprised substantially of neon at a pressure in the approximate range 40–200 torr.

12. A display device according to claim 1 wherein said base member including said conductive region and is substantially transparent.

13. A display device according to claim 1 wherein said base member including said conductive region is substantially reflective.

14. A display device according to claim 1 wherein said base member including said conductive region is substantially opaque.

15. A display device according to claim 1 wherein said base member is a sheet and said conductive region is a film disposed on said back surface of said base member and at least partially underlying said closed region.

16. A display device according to claim 15 further comprising a third non-conductive sheet member opposite said back surface of said base member and underlying said conductive region.

17. A display device according to claim 1 wherein said first sheet member is substantially transparent.

18. A display device according to claim 1 wherein said second sheet member includes means for reflecting light incident on said front surface of said second sheet member.

19. A display device according to claim 1 wherein said chamber means comprises at least one transparent, elongated tubular member, said tubular member being sealed at each end thereof.

20. A display device according to claim 1 wherein said sheet member and said base member are substantially planar and parallel rigid sheets, and wherein said chamber means comprises a plurality of transparent elongated tubular members, said tubular members being sealed at each end thereof.

21. A display device according to claim 20 wherein said tubular members are cylindrical.

22. A display device according to claim 20 wherein said tubular members have substantially parallel central axes, and wherein the outer diameter of said tubular members is less than said predetermined distance.

23. A display device according to claim 22 further comprising spacing members positioned between at least two of said tubular members, said spacing members having a dimension in the direction between said first and second sheet members substantially equal to said predetermined distance.

24. An interactive luminous display device comprising:

a. an at least partially transparent, non-conductive sheet member having front and back surfaces, said sheet member having a coupling region on portions of its front surface, said coupling region being adapted to receive thereon an externally applied conductive member;

b. a base member having front and back surfaces, and including an electrically conductive region on at least one of said surfaces;

c. spacer means for mutually positioning said sheet member and said base member whereby the back surface of said sheet member is offset by a predetermined distance from and opposite the front surface of said base member and said conductive region of said base member underlies at least a portion of said coupling region of said sheet member;

d. discharge chamber means for establishing one or more gas impervious chambers between portions of the back surface of said sheet member and the front surface of said base member, said chambers defining closed regions in the gap between said back surface of said sheet member and the front surface of said base member and lying at least partially between said coupling region and said conductive region of said base member;

e. electroluminescent gas disposed within said closed regions; and further comprising means for coupling an applied a.c. drive voltage between said conductive region and a reference potential, and wherein said device is responsive to a ground potential-coupled conductive member positioned proximal to said coupling region to generate a luminous gas discharge in the portions of said closed regions between said conductive member and said conductive region of said base member.

25. A display device according to claim 24 wherein said front and back surfaces of said first sheet member are substantially parallel.

26. A display device according to claim 25 wherein said front and back surfaces of said base member are substantially parallel.

27. A display device according to claim 24 wherein said front surface of said first sheet member and said back surface of said base member are substantially planar and mutually parallel.

28. A display device according to claim 24 wherein said base member is substantially transparent.

29. A display device according to claim 24 wherein said sheet member and said base member are materials from the group consisting of glass and polycarbonate.

30. A display device according to claim 24 wherein said spacer means includes said discharge chamber means and further includes at least one rigid spacer member disposed within said closed region and extending from one of said back surface of said sheet member and said front surface of said base member and toward the other of said surfaces.

31. A display device according to claim 30 wherein said rigid spacer members extend less than the full distance between said back surface of said sheet member and said front surface of said base member when said electroluminescent gas is at a predetermined pressure in said closed region.

32. A display device according to claim 24 wherein said electroluminescent gas is a Penning gas mixture.

33. A display device according to claim 32 wherein said gas mixture is comprised substantially of neon at a pressure in the approximate range 40–200 torr.

34. A display device according to claim 24 wherein said base member including said conductive region and is substantially transparent.

35. A display device according to claim 24 wherein said base member including said conductive region is substantially reflective.

36. A display device according to claim 24 wherein said base member including said conductive region is substantially opaque.

37. A display device according to claim 24 wherein said base member is a sheet and said conductive region is a film disposed on said back surface of said base member and at least partially underlying said closed region.

38. A display device according to claim 37 further comprising a third non-conductive sheet member opposite said back surface of said base member and underlying said conductive region.

39. A display device according to claim 24 wherein said first sheet member is substantially transparent.

40. A display device according to claim 24 wherein said second sheet member includes means for reflecting light incident on said front surface of said second sheet member.

41. A display device according to claim 24 wherein said chamber means comprises at least one transparent, elongated tubular member, said tubular member being sealed at each end thereof.

42. A display device according to claim 24 wherein said sheet member and said base member are substantially planar and parallel rigid sheets, and wherein said chamber means comprises a plurality of transparent elongated tubular members, said tubular members being sealed at each end thereof.

43. A display device according to claim 42 wherein said tubular members are cylindrical.

44. A display device according to claim 42 wherein said tubular members have substantially parallel central axes, and wherein the outer diameter of said tubular members is less than said predetermined distance.

45. A display device according to claim 44 further comprising spacing members positioned between at least two of said tubular members, said spacing members having a dimension in the direction between said first and second sheet members substantially equal to said predetermined distance.

* * * * *